US007735655B2

(12) United States Patent
Rajala

(10) Patent No.: US 7,735,655 B2
(45) Date of Patent: Jun. 15, 2010

(54) SCREEN AND METHOD FOR SCREENING PULP

(75) Inventor: Veli-Matti Rajala, Tampere (FI)

(73) Assignee: Metso Paper, Inc., Helsinki (FI)

( * ) Notice: Subject to any disclaimer, the term of this patent is extended or adjusted under 35 U.S.C. 154(b) by 587 days.

(21) Appl. No.: 11/721,302

(22) PCT Filed: Dec. 7, 2005

(86) PCT No.: PCT/FI2005/050453

§ 371 (c)(1),
(2), (4) Date: Jun. 8, 2007

(87) PCT Pub. No.: WO2006/061464

PCT Pub. Date: Jun. 15, 2006

(65) Prior Publication Data

US 2009/0236267 A1 Sep. 24, 2009

(30) Foreign Application Priority Data

Dec. 10, 2004 (FI) ..... 20045474

(51) Int. Cl.
*B07B 1/18* (2006.01)
*B07B 1/20* (2006.01)
*F24B 15/00* (2006.01)

(52) U.S. Cl. ..... 209/284; 209/300; 209/306; 209/370

(58) Field of Classification Search ..... 209/250, 209/273, 284, 300, 305, 306, 370, 372; 210/414, 210/415; 162/55, 251, 261
See application file for complete search history.

(56) References Cited

U.S. PATENT DOCUMENTS 1,053,131 A * 2/1913 Overly ..... 210/414
3,174,622 A 3/1965 Lamort
3,363,759 A 1/1968 Clarke-Pounder
3,394,809 A 7/1968 Hunter (Continued)

FOREIGN PATENT DOCUMENTS

DE 2 146 022 3/1973

(Continued)

OTHER PUBLICATIONS

Office Action from Finnish Priority Appl. No. 20045474 dated Jul. 6, 2005.

(Continued)

*Primary Examiner*—Patrick Mackey
*Assistant Examiner*—Mark Hageman
(74) *Attorney, Agent, or Firm*—Alston & Bird LLP

(57) ABSTRACT

A screen and a method for screening pulp. The screen comprises a body, a screen cylinder arranged inside the body for screening the pulp, and an accept chamber and an accept aggregate connected with it for removing the accepted pulp fraction from the screen. The accept chamber is arranged between the screening surface of the screen cylinder and the screen body and it is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the accept aggregate is arranged.

23 Claims, 7 Drawing Sheets

U.S. PATENT DOCUMENTS

| | | | | | |
|---|---|---|---|---|---|
| 3,677,402 | A | | 7/1972 | Holz | |
| 5,318,186 | A | | 6/1994 | Rienecker | |
| 5,575,395 | A | * | 11/1996 | Alajaaski et al. | 209/17 |
| 6,117,273 | A | * | 9/2000 | Flavio et al. | 162/251 |
| 6,155,430 | A | * | 12/2000 | Goodman | 210/355 |
| 2001/0017274 | A1 | | 8/2001 | Gabl et al. | |
| 2002/0069985 | A1 | | 6/2002 | Rienecker et al. | |

FOREIGN PATENT DOCUMENTS

| | | |
|---|---|---|
| WO | WO 97/13918 | 4/1997 |

OTHER PUBLICATIONS

Office Action from Finnish Priority Appl. No. 2004574 dated Mar. 16, 2006.

International Search Report for International Application No. PCT/FI2005/050453 dated Mar. 7, 2006.

Written Opinion of the International Searching authority for International Application No. PCT/FI2005/050453 dated Mar. 7, 2006.

* cited by examiner

SCREEN AND METHOD FOR SCREENING PULP

BACKGROUND OF THE INVENTION

The invention relates to a screen for screening pulp, the screen comprising a body, a screen cylinder arranged inside the body and having a cylinder surface which is provided with openings and forms a screening surface of the screen for screening the pulp, a feed chamber and a feed connection connected with it for feeding the pulp to be screened to the screen, and an accept chamber and an accept connection connected with it for removing the accepted pulp fraction from the screen, the accept chamber being arranged between the screening surface of the screen cylinder and the screen body.

The invention also relates to a screen for screening pulp, the screen comprising a body, a screen cylinder arranged inside the body and having a cylinder surface which is provided with openings and forms a screening surface of the screen for screening the pulp, a feed chamber and a feed connection connected with it for feeding the pulp to be screened to the screen, and an accept chamber and an accept connection connected with it for removing the accepted pulp fraction from the screen, the feed chamber being arranged between the screening surface of the screen cylinder and the screen body.

The invention further relates to a method for screening pulp, wherein the pulp is screened by a screen comprising a body, a screen cylinder arranged inside the body and having a cylinder surface which is provided with openings and forms a screening surface of the screen for screening the pulp, a feed chamber and a feed connection connected with it for feeding the pulp to be screened to the screen, and an accept chamber and an accept connection connected with it for removing the accepted pulp fraction from the screen, the accept chamber being arranged between the screening surface of the screen cylinder and the screen body.

The invention further relates to a method for screening pulp, wherein the pulp is screened by a screen comprising a body, a screen cylinder arranged inside the body and having a cylinder surface which is provided with openings and forms a screening surface of the screen for screening the pulp, a feed chamber and a feed connection connected with it for feeding the pulp to be screened to the screen, and an accept chamber and an accept connection connected with it for removing the accepted pulp fraction from the screen, the feed chamber being arranged between the screening surface of the screen cylinder and the screen body.

Pulp is screened in a treatment phase before it is supplied to a paper or board machine or a similar apparatus to remove from the pulp various impurities, slivers and other objects deteriorating the quality of a paper or board web to be manufactured. The apparatus for screening pulp is called a screen. The screen comprises a pressure-proof frame, i.e. a body, inside of which there is a screening surface with openings for screening the pulp. The screen also comprises a feed chamber and a feed connection connected with it for feeding the pulp to be screened to the feed chamber inside the screen. The screen further comprises an accept chamber and an accept connection connected with it for removing the accepted pulp fraction, i.e. the accept, from the accept chamber out of the screen and for feeding it forward in the process, and a reject connection for removing the fraction rejected in the screen, i.e. the reject, from the screen for further processing. The screen volume inside the body is thus divided into the feed chamber in connection with the feed connection, the accept chamber in connection with the accept connection, and a reject space in connection with the reject aggregate. The screen also typically comprises a separate discharge connection, through which the impurities accumulated on the bottom of the accept chamber can be removed from the screen.

A commonly used screen type comprises a cylindrical body, inside of which there is a screen cylinder with a cylindrical screening surface with openings for screening pulp. The openings in the screening surface may be, for instance, round or longitudinal holes or parallel slots in the surface of the screen cylinder. The screen may also comprise a rotor arranged inside the cylindrical screening surface for circulating the pulp in the screen, and foil wings fastened to the frame of the rotor and causing a strong suction pressure pulse on the screening surface while the rotor rotates, due to which the reject pulp and the fibres accumulated on the screening surface are removed from the screening surface and returned into the pulp mixture. The screen provided with a cylindrical body and a cylindrical screening surface may be used in both vertical and horizontal positions.

In screens with a cylindrical body structure, the accept chamber may be restricted to the region between the screening surface and the screen body, and the feed chamber is typically arranged at the other end of the screen. There are also screens where the feed chamber may be restricted to the region between the screening surface and the screen body, and the accept chamber is located inside the screen cylinder and at the other end of the screen. Cylindrical screens, however, are often too narrow for a flow, which causes an uneven flow through the screening surface of the screen. In practice, there have appeared dirtiness problems so that a disadvantageous geometry of the accept chamber may cause, for instance, a kaolin slurry to precipitate on the bottom of the accept chamber. Further, it is difficult to empty the cylindrical screen completely during factory shutdowns, for instance. If the application field of the screen is a machine screen, in which a clean, screened pulp is supplied to the machine screen and further to the paper or board machine, the machine screen itself may cause problems, such as web breaks, if its shape is disadvantageous for the flow. This makes the surfaces dirty and causes fibre bundles to accumulate at dead flow points.

One solution for adjusting the flows through the screening surface would be to increase the diameter of the screen body. This, however, increases the manufacturing costs of the screen considerably, a significant part of which is constituted by the flange joints required. It is also more expensive to manufacture the accept opening and its reinforcements when pressure levels become higher, because welding and arranging of an accept aggregate is craftsmanship which requires great professional skills. Further, the rest of the frame structure of the screen may comprise many different structural principles, wherefore the automation of screen manufacture and welding in particular is very limited.

U.S. Pat. No. 5,318,186 discloses a screen including two successive screen baskets and a substantially cylindrical screen body having cone and cylinder parts and convex ends. In the longitudinal direction of the screen, the diameter of the body is larger in the middle of the screen than at its ends, and this solution has been selected on the basis of the space required by the support structure needed for supporting the two screen baskets in the screen. Such a body structure does not, however, prevent the formation of dead flow points, nor does it have an advantageous effect for improving the pulp flow through the screening surface. As to the use of material, it is also very disadvantageous to manufacture the cone structure disclosed in the publication from a sheet material.

BRIEF DESCRIPTION OF THE INVENTION

It is an object of the invention to provide a new type of screen, in which the pulp to be screened flows more evenly through a screening surface than before.

The screen of the invention, wherein the accept chamber is arranged between the screening surface of the screen cylinder and the screen body, is characterized in that the accept aggregate is arranged in the longitudinal direction of the screen cylinder in a region defined by the screen cylinder and that the accept chamber of the screen is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the accept aggregate is arranged.

Furthermore, the screen of the invention, wherein the feed chamber is arranged between the screening surface of the screen cylinder and the screen body, is characterized in that the feed aggregate is arranged in the longitudinal direction of the screen cylinder in a region defined by the screen cylinder and that the feed chamber of the screen is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the feed aggregate is arranged.

Furthermore, the method of the invention, wherein pulp is screened by a screen, in which the accept chamber is arranged between the screening surface of the screen cylinder and the screen body, is characterized by feeding the pulp to be screened through the feed aggregate to the feed chamber, screening the pulp by means of the screening surface in such a manner that the accepted pulp fraction passes through the screening surface to the accept chamber, which is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the accept aggregate is arranged in a region defined by the screen cylinder in the longitudinal direction of the screen cylinder, and transferring the accepted pulp fraction from the accept chamber through the accept aggregate out of the screen.

Furthermore, the method of the invention, wherein pulp is screened by a screen, in which the feed chamber is arranged between the screening surface of the screen cylinder and the screen body, is characterized by feeding the pulp to be screened through the feed aggregate to the feed chamber, which is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the feed aggregate is arranged in a region defined by the screen cylinder in the longitudinal direction of the screen cylinder, and screening the pulp by means of the screening surface in such a manner that the accepted pulp fraction passes through the screening surface to the accept chamber, and transferring the accepted pulp fraction from the accept chamber through the accept aggregate out of the screen.

According to the essential idea of the invention, a screen for screening pulp comprises a body, a screen cylinder arranged inside the body and having a cylinder surface which is provided with openings and forms a screening surface of the screen for screening the pulp, a feed chamber and a feed aggregate connected with it for feeding the pulp to be screened to the screen, and an accept chamber and an accept aggregate connected with it for removing the accepted pulp fraction from the screen. Further, according to the essential idea, the accept chamber is arranged between the screening surface of the screen cylinder and the screen body, or the feed chamber is arranged between the screening surface of the screen cylinder and the screen body, and the accept aggregate is arranged in the longitudinal direction of the screen cylinder in a region defined by the screen cylinder, and the accept chamber is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the accept aggregate is arranged, or the feed aggregate is arranged in the longitudinal direction of the screen cylinder in a region defined by the screen cylinder, and the feed chamber of the screen is arranged to expand in the radial direction of the screen cylinder outwards from the screen cylinder continuously in the longitudinal direction of the screen cylinder towards the line which is parallel to the radius of the screen cylinder and corresponds to the cross-section of the body and on which the feed aggregate is arranged. According to an embodiment of the invention, the accept chamber or the feed chamber is arranged to expand in the radial direction of the screen cylinder in such a manner that the screen body comprises, in the region of the accept chamber or the feed chamber, a part in accordance with one radius of curvature, the radius being the same in all directions of the body.

The invention provides the advantage of a more even flow of pulp through the screening surface, since by means of the invention, it is simple to provide the accept chamber or the feed chamber with a larger cross-sectional area in the circumferential direction of the screen cylinder, which means that the accept chamber or the feed chamber is more spacious than before. At the same time, dead angles in the cylindrical body structures disadvantageous for the flow may be avoided. As the accept chamber or the feed chamber is arranged to expand in the radial direction of the screen cylinder in such a manner that the screen body comprises, in the region of the accept chamber or the feed chamber, a part in accordance with one radius of curvature, the radius being the same in all directions of the body, the body at the accept chamber or the feed chamber has almost the shape of a spherical surface, wherefore it is simple and easy to provide and fasten pipe fittings to this part of the body. The screen of the solution may very well be applied as a machine screen but is naturally also applicable in other screen positions.

BRIEF DESCRIPTION OF THE FIGURES

The invention will be described in greater detail in the attached drawings, in which FIG. 1 schematically shows a cross-section of a screen from the side, FIG. 2 schematically shows a cross-section of a second screen from the side, FIG. 3 schematically shows a cross-section of a third screen from the side, FIG. 4 schematically shows a cross-section of a fourth screen from the side, FIG. 5 schematically shows a cross-section of a fifth screen from the side, FIG. 6 schematically shows a solution for fastening the end part of a screen body to the screen body, FIG. 7 schematically shows a cross-section of a sixth screen from the side, and FIGS. 8 to 14 schematically show various embodiments of the screen body.

For the sake of clarity, the invention is simplified in the figures. Like parts are denoted by the same reference numerals.

DETAILED DESCRIPTION OF THE INVENTION

Figure 1:
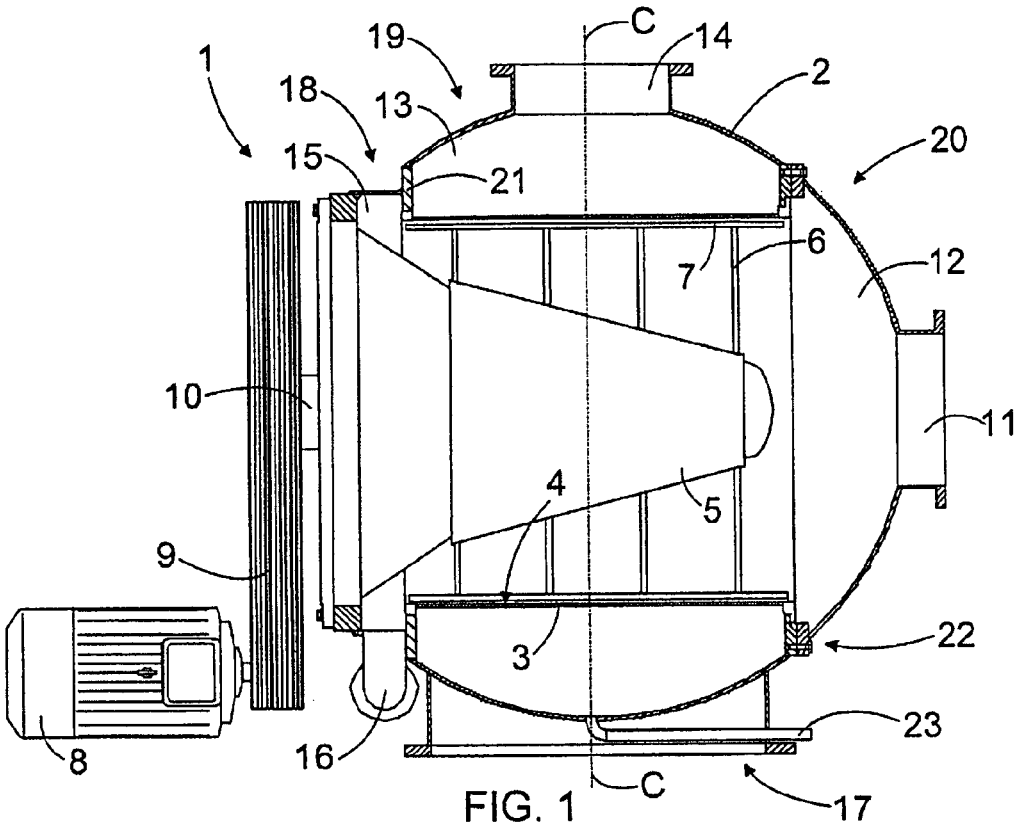

FIG. 1 schematically shows a side view and a cross-section of a screen 1 for screening pulp to be used in the manufacture of paper, board or a similar material. The screen 1 comprises a frame or body 2 of the screen 1. The screen 1 according to FIG. 1 also comprises a screen cylinder 3 which is fixedly supported in connection with the body 2 and whose cylindrical surface provided with openings forms a screening surface 4 of the screen. The openings of the screening surface may be, for instance, round or longitudinal holes or parallel slots in the screening surface 4. Inside the screen cylinder 3 there is a rotor 5 for circulating the pulp in the screen 1. By using support arms 6, the rotor 5 is connected with foil wings 7 or pulse wings 7, which rotate inside the screening surface 4 while the rotor 5 rotates and cause a strong suction pressure pulse on the screening surface 4, due to which the reject pulp and fibres accumulated on the screening surface 4 are removed from the screening surface 4 and returned to the pulp mixture. The rotor 5 is arranged to be rotated in a manner per se by means of a motor 8 and a V belt 9 in such a manner that the motor 8 is arranged to rotate the V belt 9, which is further arranged to rotate the shaft 10 of the rotor 5 and thus the entire rotor 5. Instead of a V belt drive, a gear assembly may be used.

The screen 1 also comprises a feed aggregate 11, through which the pulp to be screened is supplied to a feed chamber 12 of the screen 1. From the feed chamber 12, the pulp to be screened is transferred to the inside of the screen cylinder 3. In the screen 1 according to FIG. 1, outside the screen cylinder 3 there is an accept chamber 13 between the screen cylinder 3 and the body 2, i.e. the screening surface 4 and the body 2, to which chamber the accepted pulp fraction, i.e. the accept, which has passed through the openings of the screening surface 4 is transferred and from which accept chamber 13 the accept is further transferred in the upper part of the accept chamber 13 through an accept aggregate 14 located, in FIG. 1, at the uppermost point of the accept chamber and in a region defined by the screen cylinder 3 in the longitudinal direction of the screen cylinder 3 and protruding upwards out of the screen 1 to be supplied forward in the pulp treatment process. The rejected pulp fraction, i.e. the reject, which is the portion of the pulp fraction to be screened that has not passed through the screening surface 4 remains in a reject space 15 of the screen 1 and is removed from the screen 1 through a reject aggregate 16 for further processing. FIG. 1 also shows a base 17, by which the screen 1 is supported on its application site in a horizontal position.

The body 2 of the screen 1 according to FIG. 1 is implemented in such a manner that the cross-section of the screen 1 body 2 in the longitudinal direction of the screen cylinder 3 in the region of the accept chamber 13 is arranged to expand in the radial direction of the screen cylinder 3 outwards from the screen cylinder 3 continuously in the longitudinal direction of the screen cylinder 3 towards the imaginary cross-sectional line C-C which is parallel to the diameter of the screen cylinder 3 and on which the accept aggregate 14 is arranged. The cross-section of the body 2 of the screen 1 according to FIG. 1 in the longitudinal direction of the screen cylinder 3 in the region of the accept chamber 13 has the shape of a circular arc. The cross-section of the body 2 of the screen 1 according to FIG. 1 in the direction of the diameter of the screen cylinder 3 in the region of the accept chamber 13 also has the shape of a circular arc. In FIG. 1, the radius of curvature of the body 2 in all directions of the body 2 in the region of the accept chamber 13 is the same. In FIG. 1, the radius of curvature of the body 2 in the region of the feed chamber 12 corresponds to that in the region of the accept chamber 13, which means that the body 2 surface has the shape of a substantially spherical surface, except in the part of the screen 1, on which the rotor 5 is supported, and the locations where the aggregates necessary for bringing the pulp to the screen 1 and removing it from the screen 1 are arranged.

The body 2 of the screen 1 according to FIG. 1 substantially comprises three parts. The first part is constituted by a part 18 on the left side of FIG. 1, on which the rotor 5 is supported. The second part 19 is constituted by the middle part of the screen 1, i.e. the part forming the outermost surface of the accept chamber 13. The third part 20 is constituted by the part on the right side of FIG. 1, on which the feed aggregate 11 is arranged in FIG. 1. Between the first part 18 and the second part 19 there is FIG. 1. Between the first part 18 and the second part 19 there is a flange 21 separating the accept chamber 13 from the reject space 15. Between the second part 19 and the third part 20, i.e. the end part 20 of the body 2 of the screen 1, there is a fastening flange structure 22, by which the third part 20 is fastened to the second part 19 and which separates the accept chamber 13 from the feed chamber 12. In FIG. 1, the third part 20, i.e. the end part 20, is the part to which the feed aggregate 11 is fastened. The construction of the fastening flange structure 22 is shown in greater detail in FIG. 6. The screen cylinder 3 is supported on the flange 21 and on the fastening flange structure 22.

The pulp to be screened is supplied via the feed aggregate 11 to the feed chamber 12. The pulp is screened by means of the screening surface 4 in such a manner that the accepted pulp fraction, i.e. the accept, passes through the openings in the screening surface 4 to the accept chamber 13, from which it is further transferred through the accept aggregate 14 out of the screen 1. The reject, i.e. the part of the pulp that has not passed through the openings of the screening surface 4, is transferred to the reject space 15, from which it is further transferred through the reject aggregate 16 out of the screen 1 for further processing. By means of the rotor 5, the foil wings 7 are rotated in such a manner that the foil wings 7 cause a suction pressure pulse on the screening surface 4 to remove the reject and fibres accumulated on the screening surface 4.

Due to the shape of body 2 of the accept chamber 13, which almost corresponds to the shape of the spherical surface of the screen 1 according to FIG. 1, the cross-sectional area of the accept chamber 13 in the circumferential direction of the screen cylinder 3 is larger than before, and thus the accept chamber 13 is more spacious. Because of the solution described above it is also possible to avoid dead angles in the cylindrical body structures, which are disadvantageous for the flow. Consequently, the flow of pulp through the screening surface 4 is more even than before, because the flow of pulp accepted in the screening, i.e. the accept, through the screening surface of the screen cylinder 3 is made even when also the flow coming from the opposite side of the accept aggregate 14 through the screen cylinder 3 can flow to the accept aggregate 14 without a significant pressure difference. A larger flow area is also provided at the accept aggregate 14 without having to enlarge the flange joints or the cover structures.

Although it is more expensive to manufacture a spherical surface than a cylindrical one, the total manufacturing costs of the screen 1 are, nevertheless, lower because of other manufacture-related aspects. According to pressure vessel models, the thickness of the cylinder wall must be doubled compared to a spherical chamber to achieve the same strength, and thus the solution described saves material considerably. In addition, it is more difficult to fix different branchings and pipe fittings to a cylindrical structure than to a spherical structure. Also, in a cylindrical structure, a lot of material is wasted in extensions of the accept aggregate and its reinforcements, whereas the aggregate to be fixed to the surface of a spherical structure comprises a simple geometry, i.e. a pipe with straight ends. Furthermore, this solution allows to minimize the diameter of the end part 20 of the body 2 of the screen 1, which further reduces the manufacturing costs.

The base 17 of the screen 1 may also be made round. The end result may be a frame construction, in which the same shape principle is implemented in various locations. All weldable main components thus consist of bodies of revolution, which means that there are better preconditions for welding automation and a faster and more accurate manufacture.

The screen 1 of FIG. 1 also comprises a discharge connection 23, through which the slurry accumulated on the bottom of the accept chamber 13 may be removed from the accept chamber 13. The discharge connection 23 is arranged at the lowest point of the accept chamber 13, and due to the body 2 of the spherical accept chamber 13 the slurry is accumulated at this lowest place where it is easy to remove the slurry. In practice, it is not possible to arrange a discharge connection at the lowest point of the accept chamber in the cylindrical body structure. In the body structure having an approximately spherical shape, the lowest point of the accept chamber acts as a discharge point, even though the montage would be slightly erroneous. The discharge connection 23 may also be provided with a lateral branch not shown in the figure, from which there is a continuous discharge e.g. to a wire pit, by which it may be ensured that no harmful slurry is accumulated on the bottom of the accept chamber 13. In the screen with a cylindrical frame this arrangement is not possible.

Figure 2:
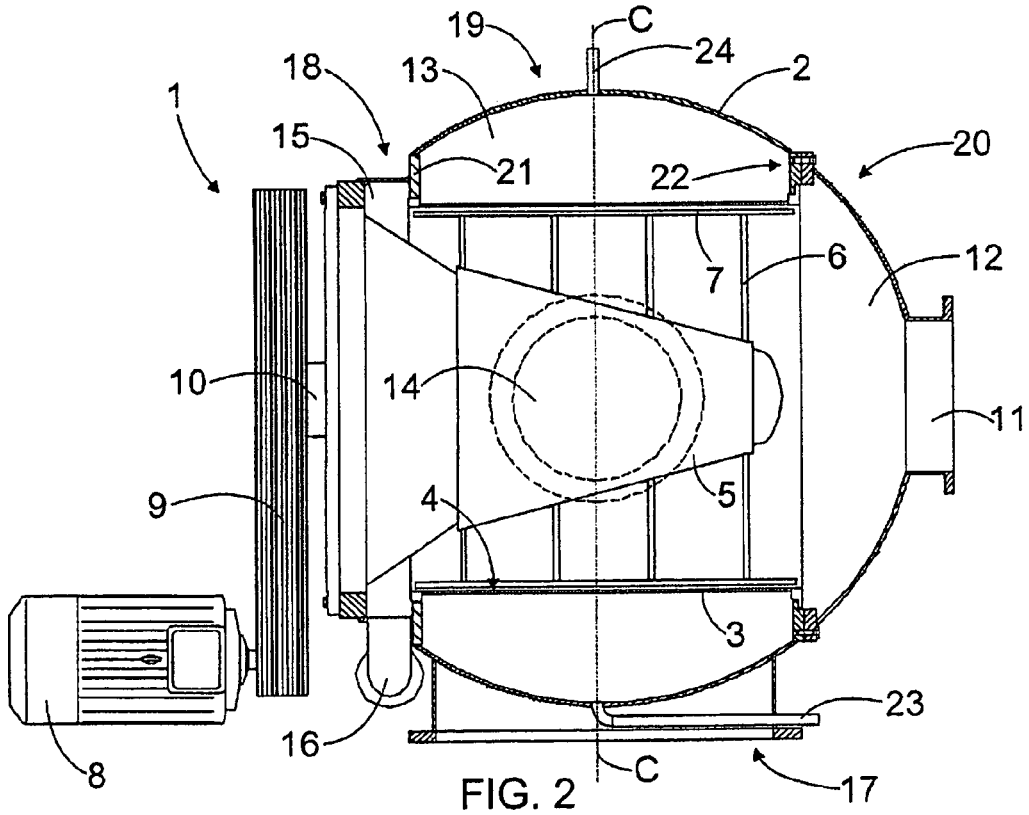

FIG. 2 schematically shows a cross-section of a second screen 1 from the side. The screen 1 shown in FIG. 2 is otherwise in accordance with the screen 1 shown in FIG. 1 but in the screen 1 according to FIG. 2, the accept aggregate 14 is arranged to be directed to the side from the accept chamber 13. The accept aggregate 14 is illustrated in FIG. 2 by means of a broken line, which means that the accept aggregate 14 is behind the screen and arranged in such a manner that its upper edge does not extend to the uppermost point of the accept chamber 13 in the vertical direction of the screen 1. An air exhaust aggregate 24 is arranged at the upper part of the accept chamber 13, preferably at the uppermost point of the accept chamber 13, as shown in FIG. 2. The air exhaust aggregate 24 may be implemented by a small pipe, and it may be used for arranging a continuous discharge from the upper part of the accept chamber 13 to the wire pit, for instance, in such a manner that no air or light particles can accumulate in the accept chamber 13. A curved, particularly spherical or arc-like shape of the body 2 of the accept chamber 13 provides the advantage that the accept chamber 13 has a distinct vertex in which the air is accumulated and from which it may be led away by a slight flow.

Figure 3:
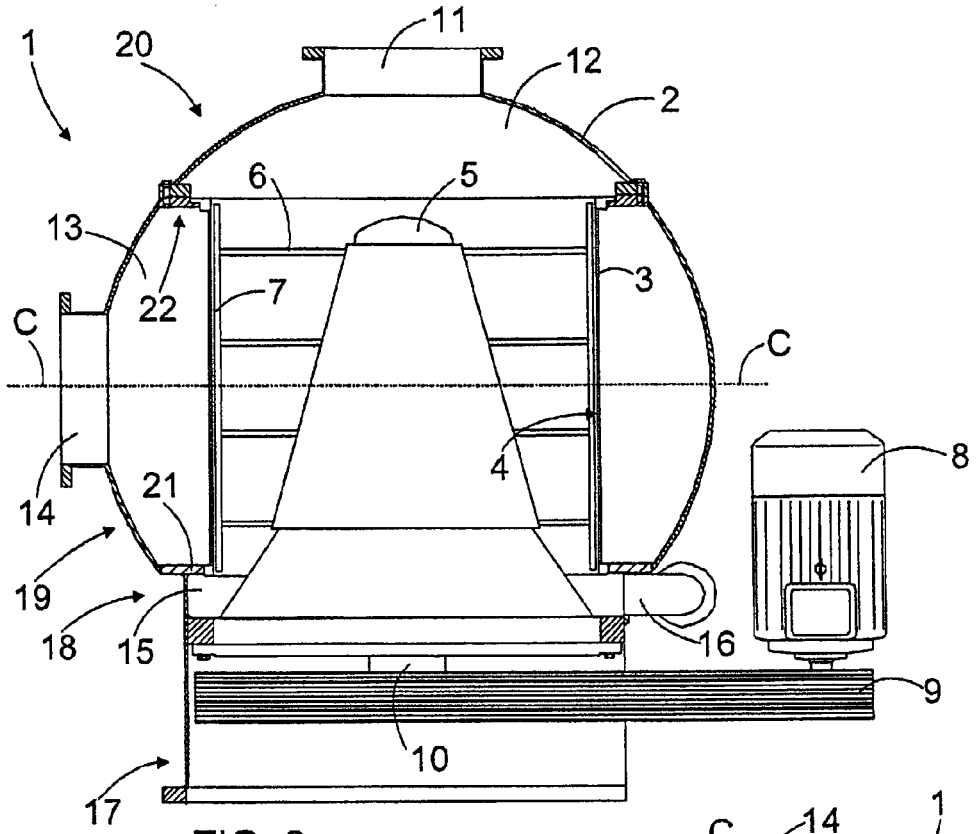

FIG. 3 schematically shows a cross-section of a third screen 1 from the side. The screen 1 shown in FIG. 3 is similar to the screen 1 of FIG. 1, but the screen 1 of FIG. 3 is in a vertical position, wherefore the base 17 of the screen is slightly elevated to facilitate the power transmission from the motor 8 to the shaft 10 of the rotor 5. In this case, the discharge connection may be arranged at the lower part of the accept chamber 13, just above the flange 21, whereby it is only used, if required, when the screen 1 is stopped.

Figure 4:
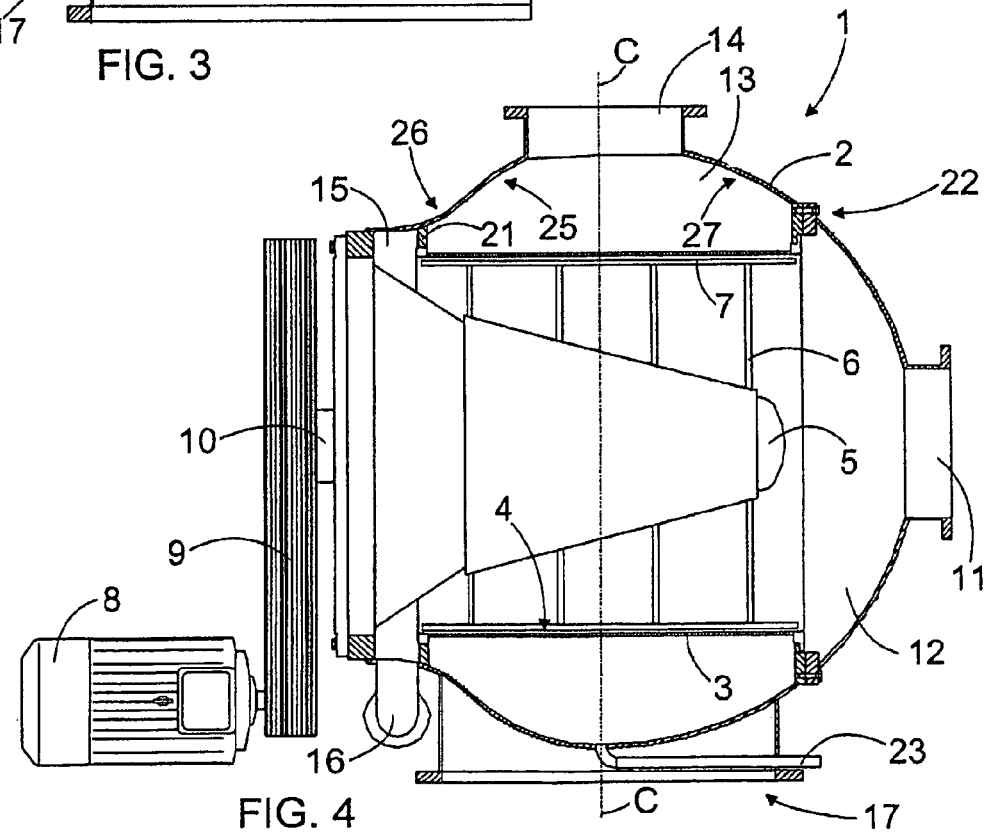

FIG. 4 schematically shows a cross-section of a fourth screen 1 from the side. The screen 1 of FIG. 4 is similar to the screen 1 shown in FIG. 1, but in the screen 1 of FIG. 4 the shape of the body 2 of the accept chamber 13 differs from the solution shown in FIG. 1 on the left side of the accept aggregate in FIG. 4. The shape of the body 2 is hereby changed in such a manner that the body 2, in this location, consists of two different parts having the shape of the radius of curvature and denoted by reference numerals 25 and 26. The part 25 of the body comprises a curved surface, whose radius of curvature has its centre point inside the body 2 of the screen 1, and the part 26 of the body comprises a curved surface, whose radius of curvature has its centre point outside the body 2 of the screen 1. In FIG. 4, the part 27 of the body of the accept chamber 13 on the right side of the accept aggregate 14 is also curved in such a manner that the centre point of its radius of curvature is inside the body 2 of the screen 1. The cross-section of the body 2 of the screen 1 according to FIG. 4 in the longitudinal direction of the screen cylinder 3 thus comprises several parts according to different radiuses of curvature in the region of the accept chamber 13. The screen 1 according to FIG. 4 still has the same manufacture- and use-related advantages as the screen of FIG. 1.

Figure 5:
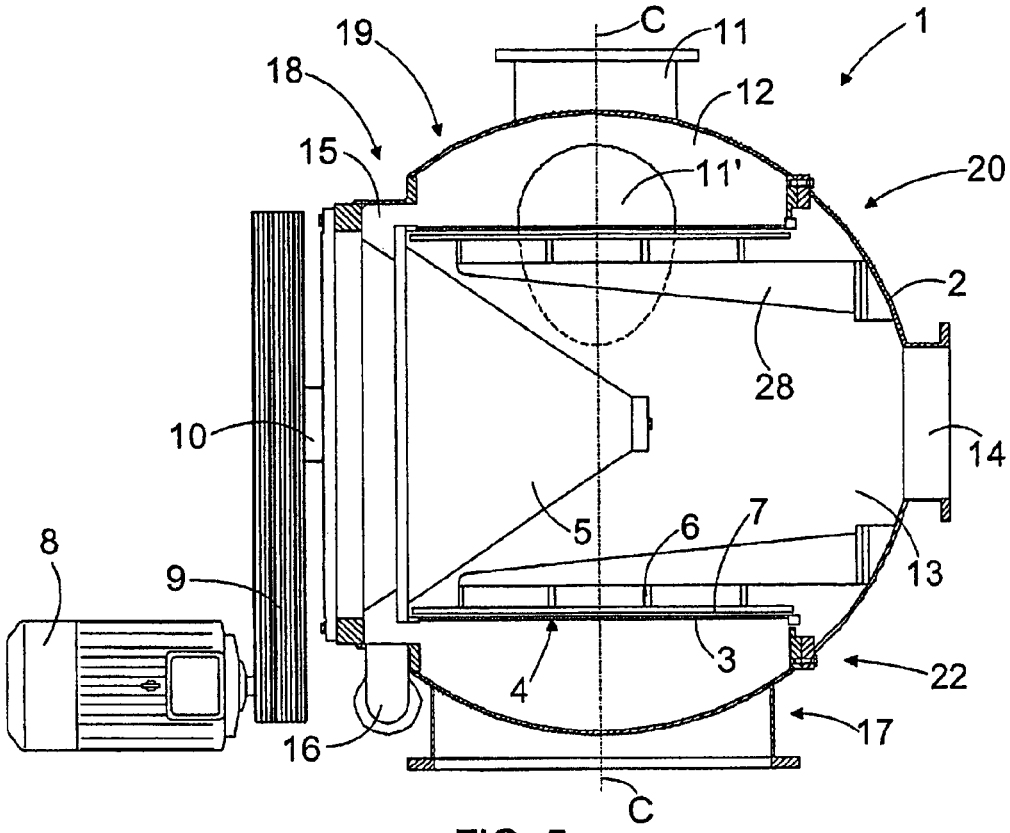

FIG. 5 schematically shows a cross-section of a fifth screen 1 from the side. The structure of the screen 1 according to FIG. 5 differs from the screens shown in FIGS. 1 to 4 in such a manner that the accept chamber 13 is inside the screen cylinder 3 and that the accept aggregate 14 is arranged horizontally at the end part 20 of the body at the end of the accept chamber 13, which end part 20 is fastened by means of the fastening flange structure 22 shown in greater detail in FIG. 6 to another part of the screen 1. The feed aggregate 11 is placed at the upper part of the screen 1 in the longitudinal direction of the screen cylinder 3 in a region defined by the screen cylinder 3 in such a manner that the pulp is supplied to the feed chamber 12 of the screen 1 tangentially from the top in a manner known per se to a person skilled in the art. A feed opening inside the body 2 is denoted by a reference numeral 11'. The feed chamber 12 is thus formed between the screen cylinder 3 and the body 2. The body 2 of the screen 1 according to FIG. 5 is thus implemented in such a manner that the cross-section of the body 2 of the screen 1 in the longitudinal direction of the screen cylinder 3 in the region of the feed chamber 12 is arranged to expand in the radial direction of the screen cylinder 3 outwards from the screen cylinder 3 continuously in the longitudinal direction of the screen cylinder 3 towards the imaginary cross-sectional line C-C which is parallel to the diameter of the screen cylinder 3 and on which the feed aggregate 11 is arranged.

The screen 1 of FIG. 5 differs from the screens shown in FIGS. 1 to 4 in such a manner that the screen basket 3 is arranged in connection with the rotor 5 such that the screen cylinder 3 rotates when the rotor 5 rotates. The foil wings 7, for their part, are arranged by means of the support arms 6 at support elements 28, which are fixedly supported in connection with the body 2 of the screen 1. As the screen cylinder 3 is rotated by means of the rotor 5, the foil wings 7 cause a suction pressure pulse on the screening surface 4, which removes the reject and the fibres accumulated on the screening surface 4. In the screen 1 of FIG. 5, the accepted pulp fraction is thus transferred through the screening surface 4 into the screen cylinder 3 and from there via the accept aggregate 14 forward in the pulp treatment process. In the screen 1 according to FIG. 5, the discharge connections may be placed at the lower edges of the feed chamber 12 and the accept chamber 13 and the air exhaust aggregate at the upper edge of the accept chamber 13.

Due to the shape of body 2 of the feed chamber 13, which almost corresponds to the shape of the spherical surface of the screen 1 according to FIG. 5, the cross-sectional area of the feed chamber 12 in the circumferential direction of the screen cylinder 3 is larger than before, and thus the feed chamber 13 is more spacious. At the same time, it is possible to avoid dead angles in the cylindrical body structures, which are disadvantageous for the flow. Consequently, the pulp flow through the screening surface 4 is more even than before, like in the screens shown in FIGS. 1 to 4.

Figure 6:
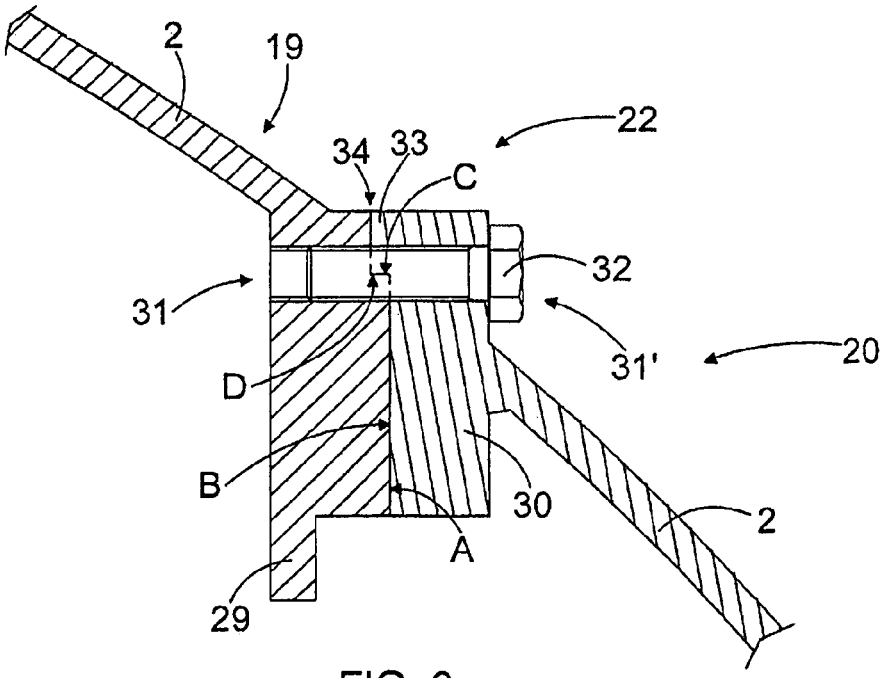

FIG. 6 schematically shows a fastening flange structure 22 for connecting the end part 20 of the body 2 of the screen 1 comprising the accept aggregate 14 or the feed aggregate 11 to the body 2 of the screen 1. In the fastening flange structure 22 of FIG. 6, the body 2 of the screen 1 comprises a first flange 29 typically fastened by welding and having a substantially vertical first surface A in FIG. 6. The end part 20 of the body 2 of the screen 1 comprises a second flange 30 typically fastened by welding and having a substantially vertical first surface B in FIG. 6. When the end part 20 of the body 2 of the screen 1 is fastened to the body 2 of the screen 1, the first surfaces A and B are set against each other in such a manner that a fastening hole 31 and a fastening hole 31' provided with threads are aligned and the end part 20 is fastened to the body 2 by means of a fastening bolt 32 or a similar fastening means, which is to be set into the fastening holes 31, 31'.

In the fastening flange structure 22 according to FIG. 6, the surface B of the flange 30 comprises a protrusion 33 directed towards the surface A of the flange 29, the protrusion 33 comprising, in FIG. 6, a substantially horizontal second surface D, which is substantially perpendicular to the first surface A of the second flange 30. In the flange 29 there is a recess 34 corresponding to the protrusion 33 and having, in FIG. 6, a substantially horizontal second surface C, which is substantially perpendicular to the first surface A of the first flange 29 and on which the surface D of the protrusion 33 is arranged to be supported. In FIG. 6, the boundary between the protrusion 33 and the recess 34 is arranged to be in the direction of the centre line of the fastening holes 31, 31'. Due to the protrusion/recess solution, the end part 20 of the body 2 of the screen 1 is supported on the recess 34 in the flange 29 of the body 2 of the screen 1 by means of the protrusion 33 and easily sets the end part 20 in its place, whereupon the protrusion/recess solution supports the fastening of the end part 20 of the body 2 of the screen and facilitates the mounting of the end part 20. Furthermore, the flange fastening solution 22 according to FIG. 6 has an exceptionally light structure and allows the end part 20 of the body 2 to be fastened easily and rapidly to the rest of the screen structure.

The fastening solution according to FIG. 6 is used in the embodiments of FIGS. 1 to 5 and 7. In the embodiments shown in FIGS. 1, 2, 4, 5 and 7 it is used for fastening the end part 20 to the body 2 of the screen 1, and in FIG. 3 for fastening the upper part of the body 2 to the screen 1.

By means of the fastening flange structure 22, it is not only possible to easily fasten the end part 20 of the body 2 of the screen 1 to the body 2 of the screen 1 but also the screen cylinder 3 can be supported on the body 2 of the screen 1 and the accept chamber 13 and the feed chamber 12 can be separated from each other.

Figure 7:
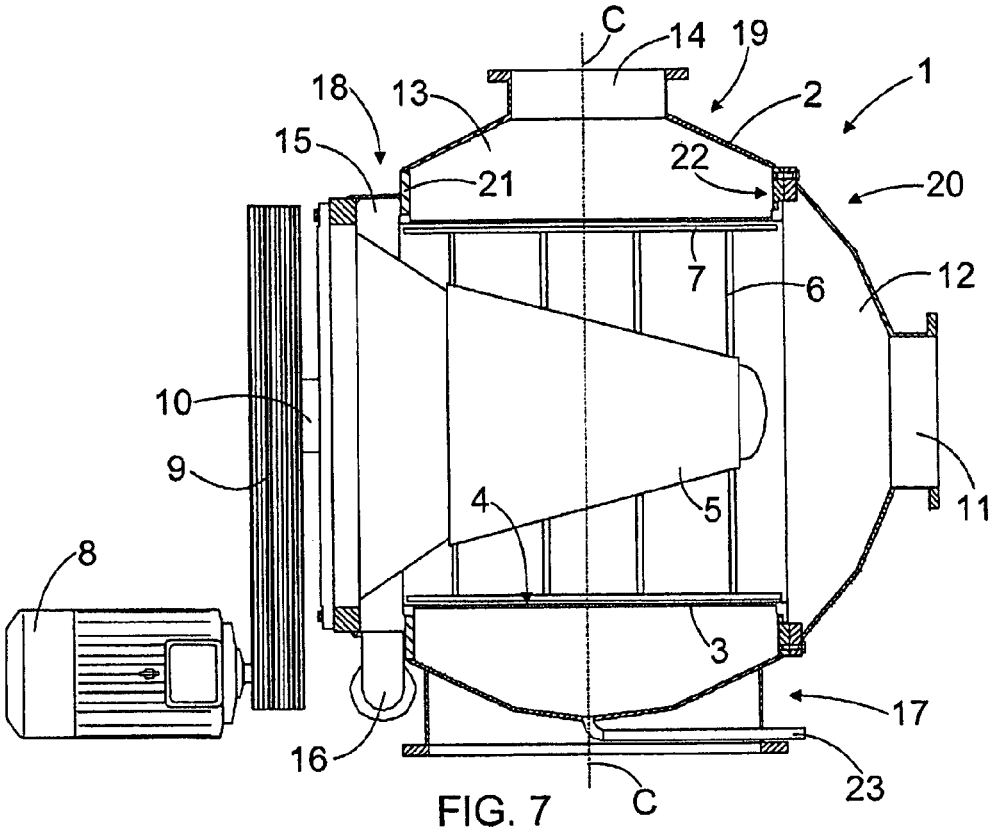

FIG. 7 schematically shows a cross-section of a sixth screen 1 from the side. The screen 1 according to FIG. 7 differs from the screen according to FIG. 1 in such a way that in the screen 1 according to FIG. 7, the substantially spherical surface of the body 2 is constituted by conical parts, the joints of which have a very obtuse angle when seen from the inside of the body 2. Characteristic of the screen 1 of FIG. 7 is also that the accept aggregate 14 is located in a region defined by the screen cylinder 3 in the longitudinal direction of the screen cylinder 3, and the cross-section of the body 2 of the screen 1 in the longitudinal direction of the screen cylinder 3 in the region of the accept chamber 13 is arranged to expand in the radial direction of the screen cylinder 3 outwards from the screen cylinder 3 continuously in the longitudinal direction of the screen cylinder 3 towards the imaginary cross-sectional line C-C which is parallel to the diameter of the screen cylinder 3 and on which the accept aggregate 14 is arranged. In the screen according to FIG. 7, the cross-sectional area of the accept chamber 13 in the circumferential direction of the screen cylinder 3 is larger than before, which means that the accept chamber 13 is more spacious. Also, the accept chamber 13 does not comprise any dead angles disadvantageous for the flow, which makes the flow of pulp through the screening surface 4 more even, like in the screens shown in FIGS. 1 to 4, for instance.

Figure 8:
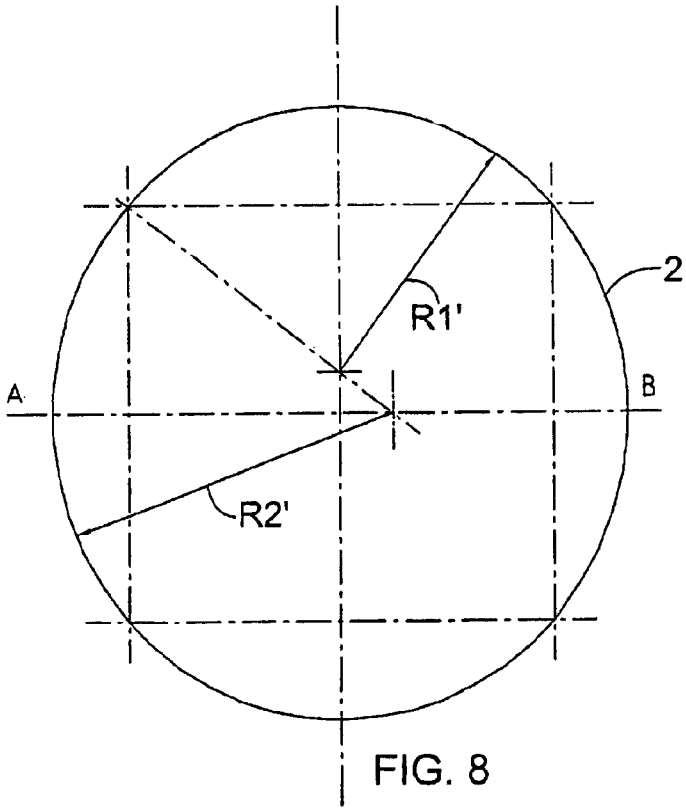
Figure 9:
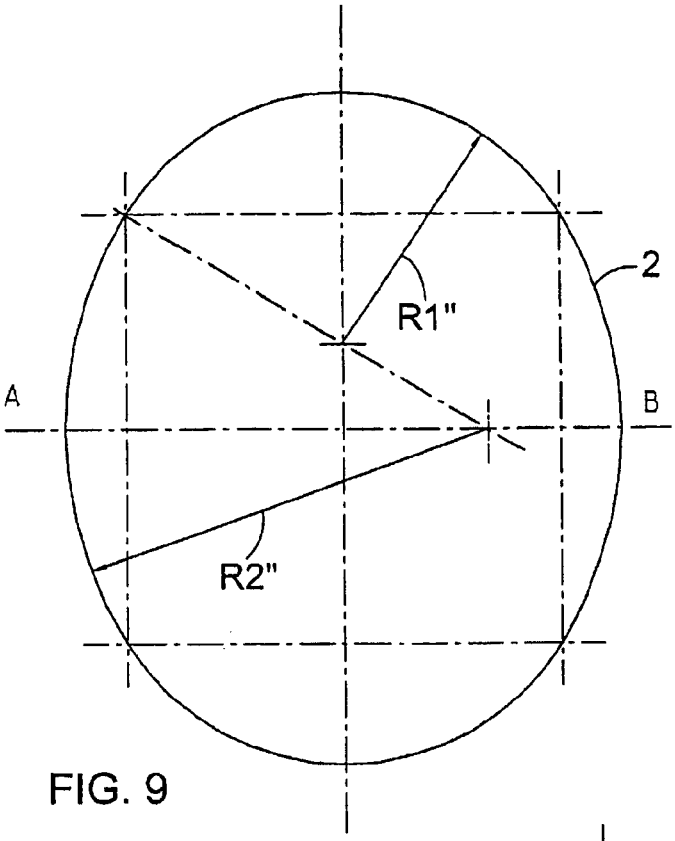

FIGS. 8 to 14 schematically illustrate different shapes of the body 2 of the screen 1. In FIGS. 8 and 9, the body 2 comprises parts in accordance with two different radiuses of curvature, R1', R2' and R1" and R2". The centre points of the first radiuses of curvature R1', R1" are inside the body 2 on the vertical diameter of the body 2, and the centre points of the second radiuses of curvature R2', R2" are inside the body 2 on the horizontal diameter of the body 2.

Figure 10:
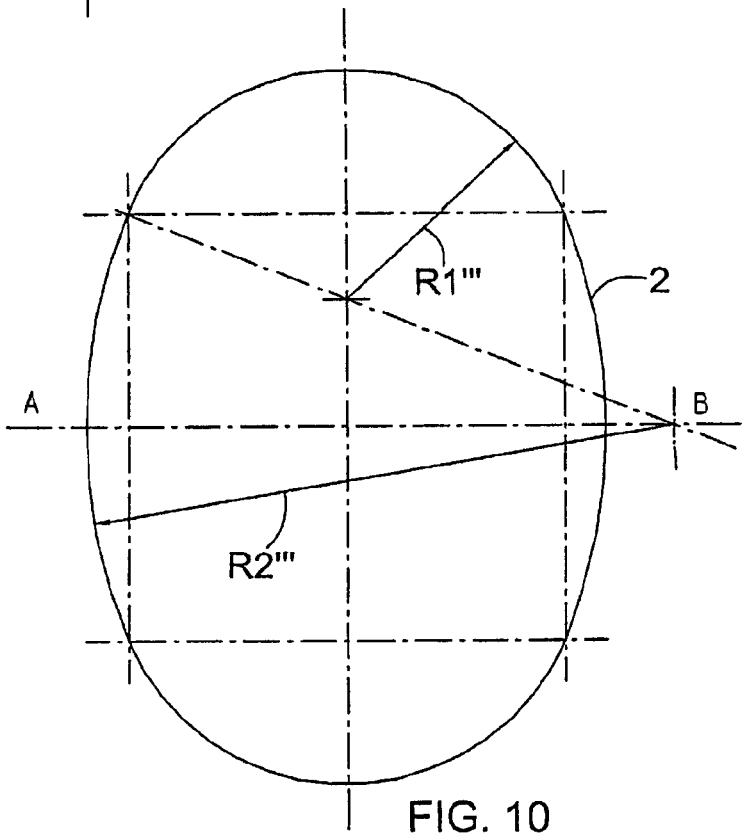
Figure 11:
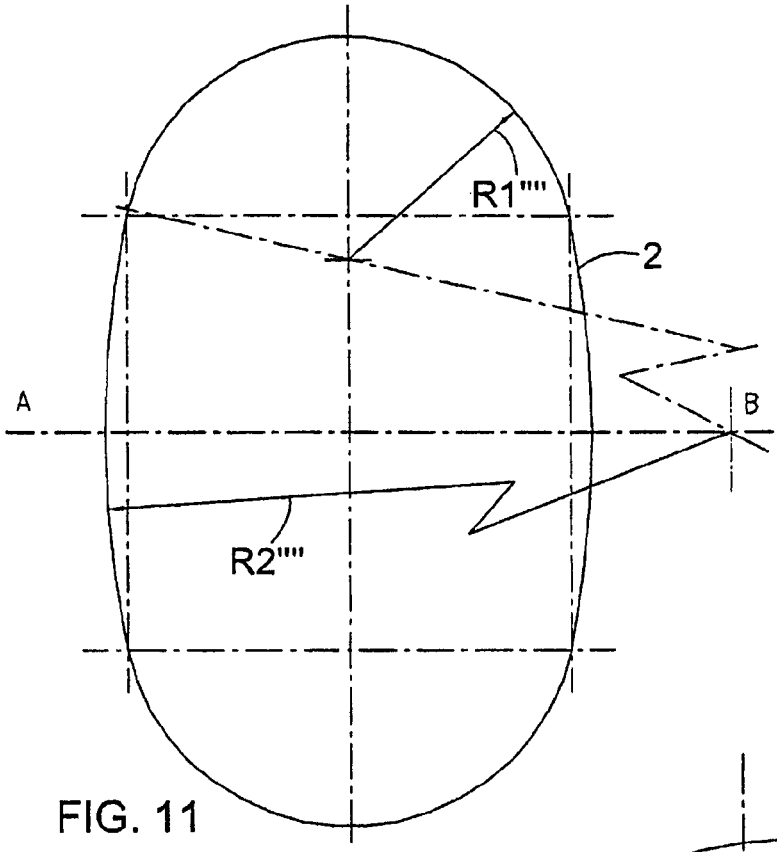

The bodies 2 shown in FIGS. 10 and 11 also comprise parts in accordance with two different radiuses of curvature R1'", R2'" and R1"" and R2"". The centre points of the first radiuses of curvature R1'", R1"" are inside the body 2 on the vertical diameter of the body 2 and the centre points of the second radiuses of curvature R2'", R2"" are outside the body 2 on the horizontal diameter of the body 2.

Figure 12:
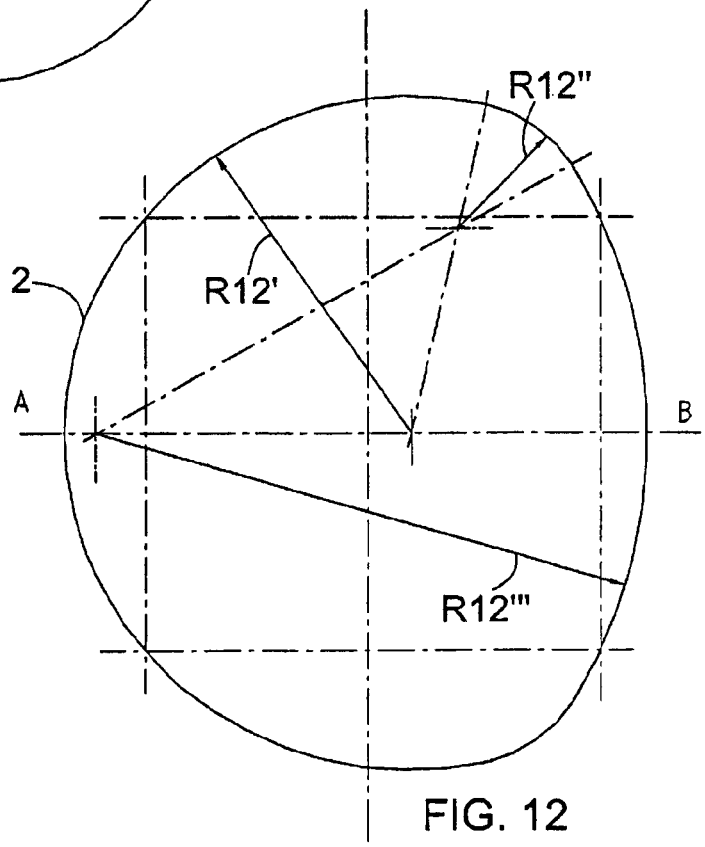

The body 2 shown in FIG. 12 comprises three different radiuses of curvature R12', R12" and R12'", the centre points of which are inside the body 2, and the centre points of the radiuses of curvature R12' and R12'" are on the horizontal diameter of the body 2. The tangents of the arc corresponding to the radius of curvature R12" meet the tangents of the arcs corresponding to the radiuses of curvature R12' and R12'".

Figure 13:
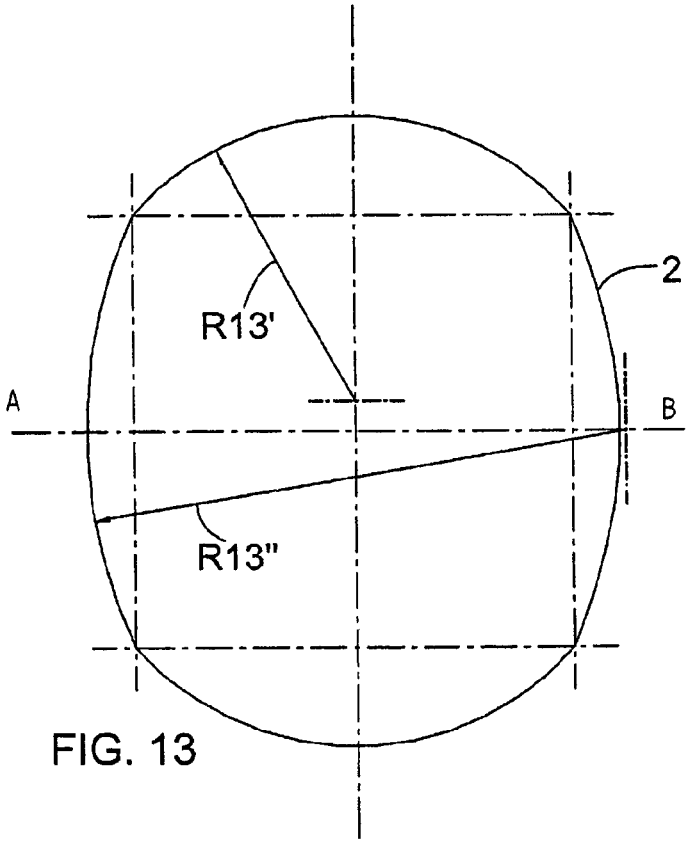

The body 2 shown in FIG. 13 comprises two different radiuses of curvature R13' and R13". The centre point of the radius of curvature R13' is inside the body 2 on the vertical diameter of the body 2, and the centre point of the radius of curvature R13" is on the horizontal diameter of the body 2.

Figure 14:
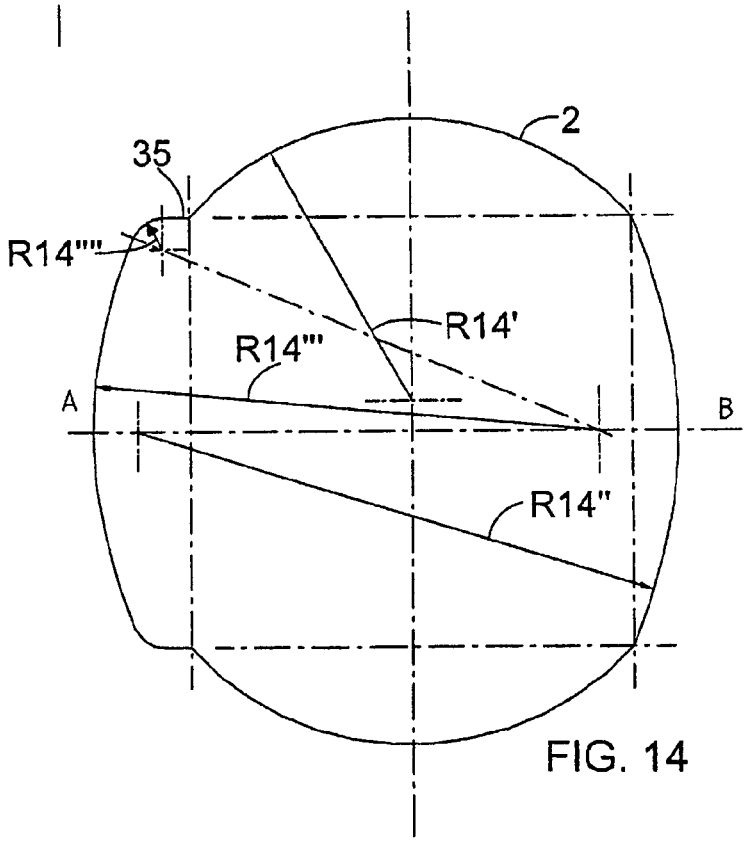

The body shown in FIG. 14 comprises parts in accordance with four different radiuses of curvature R14', R14", R14'" and R14"", the centre points of which are inside the body 2, the centre point of the radius of curvature R14' being on the vertical diameter of the body 2, dividing the body 2 into substantially two equal parts, and the centre points of the radiuses of curvature R14" and R14"" being on the horizontal diameter of the body 2. The tangents of the arcs corresponding to the radiuses of curvature R14' and R14" and the tangents of the arcs corresponding to the radiuses of curvature R14'" and R14"" meet. The space defined by the radiuses of curvature R14'" and R14"" in the body surface may correspond to the feed or accept chamber of the solutions typical in connection with screens, whereby particularly the space of the radius of curvature R14' outside the screen cylinder 3 defines the accept or feed chamber of the invention. The body 2 according to FIG. 14 also comprises a straight section 35 between the body 2 parts corresponding to the radiuses of curvature R14' and R14"", and thus the body 2 part consisting of the radiuses of curvature R14"' and R14"" and the straight section 35 may be used for providing a reject space 15 of the screen 1, for instance.

FIGS. 8 to 13 show body solutions, inside of which the screen cylinder and other parts inside the screen body and illustrated by the examples are located. With respect to the body solutions, these parts are located preferably in such a manner that the screen cylinder is on the axis parallel to the vertical or horizontal diameter of the body. In FIG. 14, the axis of the screen cylinder is preferably on the axis parallel to the horizontal diameter of the body. The screen parts inside the body may be located centrally or eccentrically with respect to the space defined by the body. If they are placed eccentrically, a larger space may be provided in the direction of the accept or feed aggregate, whereupon the cross-sectional flow area on the side of the aggregate is preferably larger, allowing a more even flow in the accept or feed chamber.

The drawings and the related description are only intended to illustrate the idea of the invention. In its details, the invention may vary within the scope of the claims. Thus, unlike the pressure screen shown in the examples of the figures, the above-described screen body structure may also be used in other machine screens as well as in coarse and fine screens.

The invention claimed is:

1. A screen for screening pulp, the screen comprising:

a body;

a screen cylinder arranged inside the body and having a cylinder surface which is provided with openings and forms a screening surface of the screen for screening the pulp;

a feed chamber and a feed aggregate connected with the feed chamber for feeding the pulp to be screened to the screen;

an accept chamber and an accept aggregate connected with the accept chamber for removing the accepted pulp fraction from the screen, wherein the accept chamber is arranged between the screening surface of the screen cylinder and the screen body, and the accept aggregate is arranged in the longitudinal direction of the screen cylinder in a region defined by a length of the screen cylinder; and, wherein the accept chamber of the screen is arranged to become larger in a curved manner in the radial direction of the screen cylinder outwards from the screen cylinder continuously in the longitudinal direction of the screen cylinder towards a line which is parallel to the radius of the screen cylinder and corresponds to a cross-section of the body on which the accept aggregate is arranged.

2. A screen as claimed in claim 1, wherein the screen cylinder is arranged substantially horizontally in connection with the body of the screen and the accept aggregate is arranged to protrude upwards from the accept chamber.

3. A screen as claimed in claim 1, wherein the screen cylinder is arranged in a substantially horizontal position in connection with the body of the screen and the accept aggregate is arranged to protrude sidewards from the accept chamber.

4. A screen as claimed in claim 1, wherein the screen cylinder is arranged in a substantially vertical position in connection with the body of the screen and the accept aggregate is arranged to protrude sidewards from the accept chamber.

5. A screen as claimed in claim 1, wherein the screen also comprises a discharge connection, which is arranged at the lowest point of the accept chamber and which removes the slurry accumulated on the bottom of the accept chamber.

6. A screen as claimed in claim 1, wherein the screen cylinder is fixedly arranged in connection with the body of the screen and the screen also comprises a rotor and foil wings arranged in connection with it, the wings being arranged to be rotated by means of the rotor in such a manner that the foil wings cause a suction pressure pulse on the screening surface for removing the reject and fibres accumulated on the screening surface from the screening surface.

7. A screen for screening pulp, the screen comprising:

a body;

a screen cylinder arranged inside the body and having a cylinder surface which is provided with openings and forms a screening surface of the screen for screening the pulp;

a feed chamber and a feed aggregate connected with the feed chamber for feeding the pulp to be screened to the screen;

an accept chamber and an accept aggregate connected with the accept chamber for removing the accepted pulp fraction from the screen, wherein the feed chamber is arranged between the screening surface of the screen cylinder and the screen body, and the feed aggregate is arranged in the longitudinal direction of the screen cylinder in a region defined by the screen cylinder; and, wherein the feed chamber of the screen is arranged to become larger in a curved manner in the radial direction of the screen cylinder outwards from the screen cylinder continuously in the longitudinal direction of the screen cylinder towards a line which is parallel to the radius of the screen cylinder and corresponds to a cross-section of the body on which the feed aggregate is arranged.

8. A screen as claimed in claim 7, wherein the screen cylinder is supported in a substantially horizontal position in a rotating manner in connection with the rotor of the screen, the feed aggregate is arranged at the upper part of the feed chamber in such a manner that the pulp is arranged to be supplied tangentially to the feed chamber and the accept aggregate is arranged horizontally at the end of the accept chamber.

9. A screen as claimed in claim 7, wherein the screen also comprises a rotor, in connection with which the screen cylinder is arranged, and the screen also comprises foil wings arranged in connection with the body of the screen, such that when the screen cylinder is rotated by means of the rotor, the foil wings cause a suction pressure pulse on the screening surface for removing the reject and fibres accumulated on the screening surface from the screening surface.

10. A screen as claimed in claim 1 or 7, wherein the accept chamber or the feed chamber of the screen is arranged to become larger in the radial direction of the screen cylinder in such a manner that the body of the screen comprises, in the region of the accept chamber or the feed chamber, a part in accordance with one radius of curvature, which is the same in all directions of the body.

11. A screen as claimed in claim 1 or 7, wherein the accept chamber or the feed chamber of the screen is arranged to become larger in the radial direction of the screen cylinder in such a manner that the body of the screen comprises, in the region of the accept chamber or the feed chamber, several parts in accordance with different radiuses of curvature.

12. A screen as claimed in claim 1 or 7, wherein the body of the screen comprises an end part removable from the body of the screen and that the body of the screen comprises a first flange and a first surface thereon and that the end part comprises a second flange and a first surface thereon, such that during the assembly of the screen the first surfaces of the flanges are set against each other in such a manner that fastening holes in the flanges are aligned, whereby the end part of the screen body may be fastened to the body of the screen by using fastening means that are to be arranged at the fastening holes.

13. A screen as claimed in claim 12, wherein the first flange comprises a recess, which has a second surface substantially perpendicular to the first surface, and the second flange comprises a protrusion, which has a second surface that is substantially perpendicular to the first surface and which may be arranged to be supported on the second surface in the first flange when the part of the screen body is mounted on the screen.

14. A screen as claimed in claim 1 or 7, wherein the screen is a machine screen, a coarse screen or a fine screen.

15. A screen as claimed in claim 11, wherein that the centre point of at least one radius of curvature is outside the screen.

16. A method for screening pulp, wherein the pulp is screened by a screen comprising a body, a screen cylinder arranged inside the body and having a cylinder surface which is provided with openings and forms a screening surface of the screen for screening the pulp, a feed chamber and a feed aggregate connected with the feed chamber for feeding the pulp to be screened to the screen, and an accept chamber and an accept aggregate connected with the accept chamber for removing the accepted pulp fraction from the screen, the accept chamber being arranged between the screening surface of the screen cylinder and the screen body, the method comprising:

feeding the pulp to be screened through the feed aggregate to the feed chamber;

screening the pulp by means of the screening surface in such a manner that the accepted pulp fraction passes through the screening surface to the accept chamber, which is arranged to become larger in a curved manner in the radial direction of the screen cylinder outwards from the screen cylinder continuously in the longitudinal direction of the screen cylinder towards a line which is parallel to the radius of the screen cylinder and corresponds to a cross-section of the body on which the accept aggregate is arranged in a region defined by a length of the screen cylinder in the longitudinal direction of the screen cylinder; and transferring the accepted pulp fraction from the accept chamber through the accept aggregate out of the screen.

17. A method as claimed in claim 16, wherein the screen cylinder is fixedly arranged in connection with the body of the screen and the screen also comprises a rotor and foil wings arranged in connection with it, and wherein the foil wings are rotated by means of the rotor in such a manner that the foil wings cause a suction pressure pulse on the screening surface for removing the reject and fibres accumulated on the screening surface from the screening surface.

18. A method for screening pulp, wherein the pulp is screened by a screen comprising a body, a screen cylinder arranged inside the body and having a cylinder surface which is provided with openings and forms a screening surface of the screen for screening the pulp, a feed chamber and a feed aggregate connected with the feed chamber for feeding the pulp to be screened to the screen, and an accept chamber and an accept aggregate connected with the accept chamber for removing the accepted pulp fraction from the screen, the feed chamber being arranged between the screening surface of the screen cylinder and the screen body (2), the method comprising:

feeding the pulp to be screened through the feed aggregate to the feed chamber, which is arranged to become larger in a curved manner in the radial direction of the screen cylinder outwards from the screen cylinder continuously in the longitudinal direction of the screen cylinder towards a line which is parallel to the radius of the screen cylinder and corresponds to a cross-section of the body on which the feed aggregate is arranged in a region defined by the length of the screen cylinder in the longitudinal direction of the screen cylinder; and screening the pulp by means of the screening surface in such a manner that the accepted pulp fraction passes through the screening surface to the accept chamber; and transferring the accepted pulp fraction from the accept chamber through the accept aggregate out of the screen.

19. A method as claimed in claim 18, wherein the screen also comprises a rotor, in connection with which the screen cylinder is arranged and that the screen also comprises foil wings arranged in connection with the body of the screen, and wherein the screen cylinder is rotated by means of the rotor in such a manner that the foil wings cause a suction pressure pulse on the screening surface for removing the reject and fibres accumulated on the screening surface from the screening surface.

20. A method as claimed in claim 16 or 18, wherein the screen also comprises a reject space and a reject aggregate and that the pulp which has accumulated in the reject space and which has not passed through the screening surface is transferred through the reject aggregate out of the screen for further processing.

21. A method as claimed in claim 16 or 18, wherein the accept chamber or the feed chamber of the screen becomes larger in the radial direction of the screen cylinder in such a manner that the body of the screen comprises, in the region of the accept chamber or the feed chamber, a part in accordance with one radius of curvature, which is the same in all directions of the body.

22. A method as claimed in claim 16 or 18, wherein the accept chamber or the feed chamber of the screen becomes larger in the radial direction of the screen cylinder in such a manner that the body of the screen comprises, in the region of the accept chamber or the feed chamber, several parts in accordance with different radiuses of curvature.

23. A method as claimed in claim 22, wherein the centre point of at least one radius of curvature is outside the screen.

* * * * *